US008534535B2

(12) United States Patent
Nickell et al.

(10) Patent No.: US 8,534,535 B2
(45) Date of Patent: Sep. 17, 2013

(54) ENVELOPE WITH SEALED DISPLAY RACK HOLE

(75) Inventors: David Nickell, Bloomingdale, IL (US); Paul Johnson, Hanover Park, IL (US)

(73) Assignee: Victor Envelope Manufacturing Corporation, Bensenville, IL (US)

( * ) Notice: Subject to any disclaimer, the term of this patent is extended or adjusted under 35 U.S.C. 154(b) by 565 days.

(21) Appl. No.: 12/615,540

(22) Filed: Nov. 10, 2009

(65) Prior Publication Data

US 2011/0108612 A1 May 12, 2011

(51) Int. Cl.
*B65D 27/04* (2006.01)
*B65D 27/00* (2006.01)

(52) U.S. Cl.
USPC ..... 229/71; 229/75

(58) Field of Classification Search
USPC ..... 229/71, 74, 75, 92.8, 87.15, 87.16, 229/87.17, 117.18, 68.2; 383/9, 7, 10, 84, 383/86, 106, 16, 67
See application file for complete search history.

(56) References Cited

U.S. PATENT DOCUMENTS

| | | | | |
|---|---|---|---|---|
| 768,670 | A | 8/1904 | Martin | |
| 1,865,037 | A * | 6/1932 | Novick | 493/220 |
| 1,969,428 | A * | 8/1934 | Schwartz | 229/74 |
| 2,732,064 | A | 1/1956 | Quackenbush | |
| 2,993,313 | A | 7/1961 | Hogan | |
| 3,278,015 | A | 10/1966 | Bernstein | |
| 3,616,991 | A | 11/1971 | Beck | |
| 4,430,843 | A | 2/1984 | Favale | |
| 4,462,538 | A * | 7/1984 | Gendron | 229/68.1 |
| 4,690,322 | A * | 9/1987 | Burns | 229/80 |
| 5,184,724 | A | 2/1993 | Mayled | |
| 5,927,592 | A | 7/1999 | Kranz | |
| 6,220,505 | B1 * | 4/2001 | Flynn et al. | 229/75 |
| 6,431,433 | B2 * | 8/2002 | Kaden et al. | 229/80 |
| 6,471,053 | B1 | 10/2002 | Feibelman | |
| 6,709,018 | B2 * | 3/2004 | Phillips | 283/116 |
| 6,758,341 | B1 | 7/2004 | Johnston | |
| 6,866,184 | B2 * | 3/2005 | Wood | 229/71 |
| 2002/0164088 | A1 | 11/2002 | Collins | |
| 2003/0085261 | A1 * | 5/2003 | Wierer et al. | 229/71 |
| 2003/0141352 | A1 * | 7/2003 | Smith et al. | 229/71 |
| 2006/0198560 | A1 | 9/2006 | Petit et al. | |

FOREIGN PATENT DOCUMENTS

| | | | |
|---|---|---|---|
| EP | 21380 | A1 * | 1/1981 |
| EP | 553413 | A1 * | 8/1993 |
| EP | 1876103 | A1 * | 1/2008 |
| GB | 2069456 | A * | 8/1981 |

* cited by examiner

*Primary Examiner* — Jes F Pascua
(74) *Attorney, Agent, or Firm* — Perkins IP Law Group LLC; Jefferson Perkins

(57) ABSTRACT

An envelope having a compartment and a sealed display rack hole is made from a single blank and has a front panel, two side flaps, a top flap, and a bottom flap. Each flap is integrated with the front panel and folds around a respective fold line to form the compartment. The front panel and either the top or bottom flap each have a display rack hole disposed to register with one another when the flap having the display rack hole is folded around its fold line. The front panel is affixed to the flap having the second display rack hole, preferably with adhesive or by heat sealing, to create an area that seals the display rack holes from the compartment. In preferred embodiments, the front panel has a window covered with transparent sheet.

9 Claims, 3 Drawing Sheets

ENVELOPE WITH SEALED DISPLAY RACK HOLE

BACKGROUND OF THE INVENTION

The present invention relates to envelopes, particularly envelopes having a display rack hole sealed from the main compartment.

Envelopes come in a wide variety of shapes and sizes and have features that are adapted directly for their intended purpose. For example, some envelopes are expandable to accommodate contents that vary in size, while others contain printing on the inside to prevent reading of the documents inside.

In contrast, some envelopes are designed with visibility in mind. These envelopes often have trademarks or designs printed on the front, have holes so that the envelopes may be hung on display racks to increase their visibility, or have windows cut into them that allow the user to see the envelope's contents.

Depending on the size of the contents, however, a display rack hole in an envelope may allow the contents to escape even though the envelope itself is sealed. This is particularly true for small items such as seeds, nails, bolts, screws, beads, etc. Thus, a need exists for an envelope having a display rack hole which is sealed from the main compartment of the envelope and does not allow the contents to escape.

SUMMARY OF THE INVENTION

According to one aspect of the invention, an envelope is formed from a blank and comprises a front panel, a first side flap, and a second side flap. The front panel has a first display rack hole and the first and second side flaps are each integrated with the front panel on opposing sides. A top flap is integrated with the front panel on a third side and is foldable around a first fold line. A bottom flap is integrated with the front panel on a fourth side that is opposite the third side and has a second fold line. Either the top flap or the bottom flap has a second display rack hole that registers with the first display rack hole when the flap is folded around its fold line to be adjacent to the front panel. The front panel and ones of the flaps form a compartment for containing the contents of the envelope and the front panel is affixed to the flap having the second display rack hole and an area proximate to the first and second display rack holes forms a seal from the compartment.

Preferably, a perimeter around the display rack holes is sealed with adhesive or heat. More preferably, the envelope contains a window.

A process for forming an envelope comprises the steps of transporting a blank to a panel cutter at a first position, and cutting a cut-out from the blank. The cut-out has a first display rack hole, a top flap, a bottom flap, and a second display rack hole in one of the top and bottom flaps. While the cut-out remains at the first position, the cut-out is scored along a first fold line such that the first display rack hole registers with the second display rack hole when the flap having the second display rack hole is rotated around its fold line to be adjacent to the cut-out.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
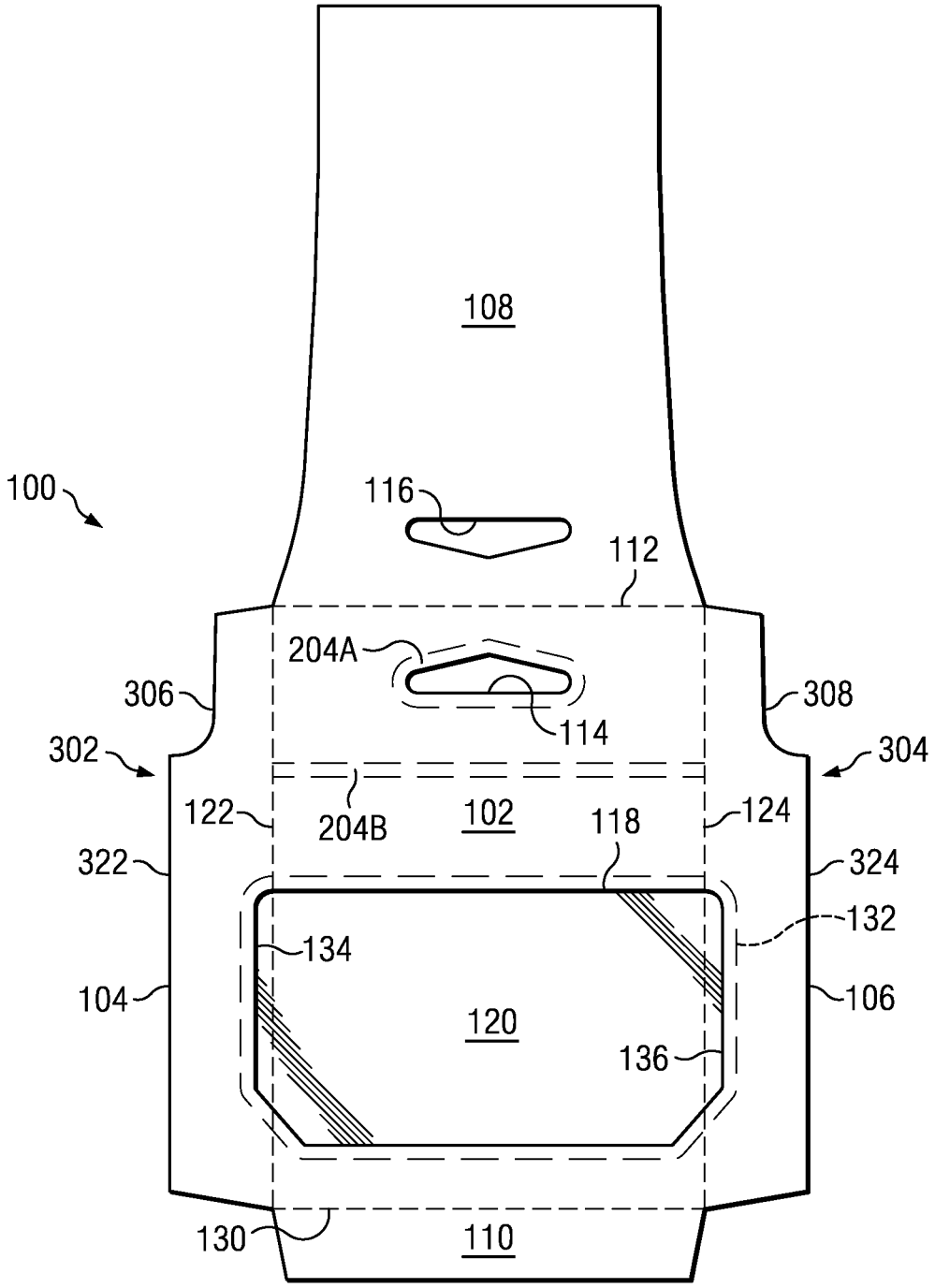
FIG. 1 is a plan view of an unassembled envelope according to one embodiment of the invention.

Referring to FIG. 1, an envelope, indicated generally at 100, comprises a front panel 102, a first side flap 104, a second side flap 106, a top flap 108, and a bottom flap 110. The first side flap 104 is integrated with the front panel 102 on a first side of the front panel and the second side flap 106 is integrated with the front panel 102 on a second side that is opposite the first side. The top flap 108 is integrated with the front panel 102 on a third side of the front panel and is foldable around a first fold line 112. The bottom flap 110 is also integrated with the front panel 102 on a fourth side that is opposite the third side and has a second fold line 130. The front panel 102 has a first display rack hole 114 and either the top flap 108 or the bottom flap 110 has a second display rack hole 116 which is disposed to be in registry with the first display rack hole 114 when the flap having the second display rack hole 116 is folded around its fold line to be adjacent to front panel 102. As shown in FIG. 1, the top flap 108 has the second display rack hole 116.

Alternatively, the second display rack hole 116 may be formed in the bottom flap 110 (not shown) such that when the bottom flap is folded around the second fold line 130 to be adjacent to the front panel 102, the second display rack hole 116 registers with the first display rack hole 114.

Figure 2:
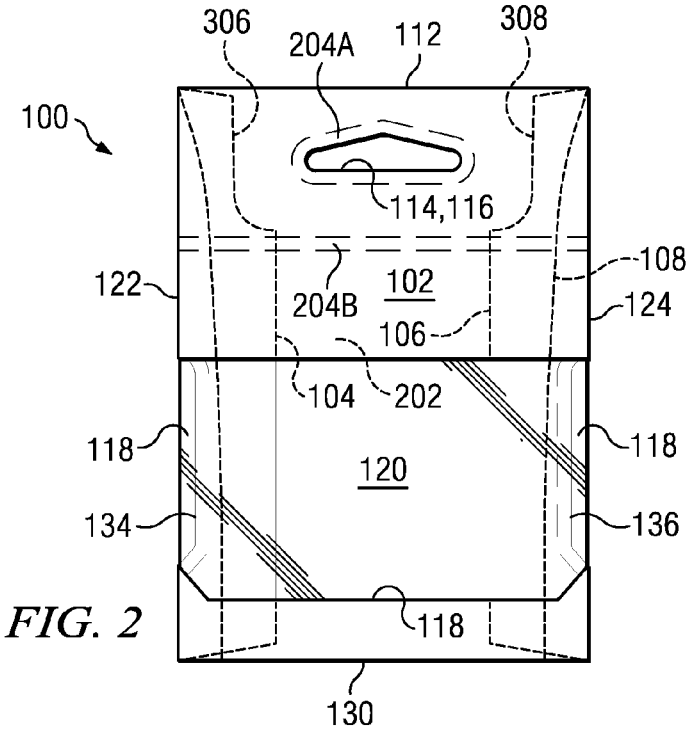
FIG. 2 is a plan view of an assembled envelope showing a front panel, a window, and transparent sheet according to the embodiment of FIG. 1.

Referring to FIG. 2, when the envelope 100 is fully assembled, the front panel and the flaps form a compartment 202 for holding the contents of the envelope. The front panel 102 is affixed to the flap that has the second display rack hole 116 and an area 204 proximate to the first and second display rack holes 114, 116 forms a seal from the compartment 202. Preferably, the area is sealed with adhesive or heat. In preferred embodiments, the area 204 forms a peripheral seal 204A around the first and second display rack holes 114, 116. Alternatively, the area 204 forms a sealed band 204B which seal compartment 202 from the folded top of the envelope 100, where the registered rack holes 114, 116 are located.

It is advantageous to form the envelope 100 from a single blank of material because it reduces the number of processing steps, increases production speed, and reduces labor. In some embodiments, the necessary features can be formed in the blank using a single die. Suitable materials include thin sheets of polymer, paper, cardboard, or fiberboard. As used herein, the term "paper" includes any cellulose product.

Figure 3:
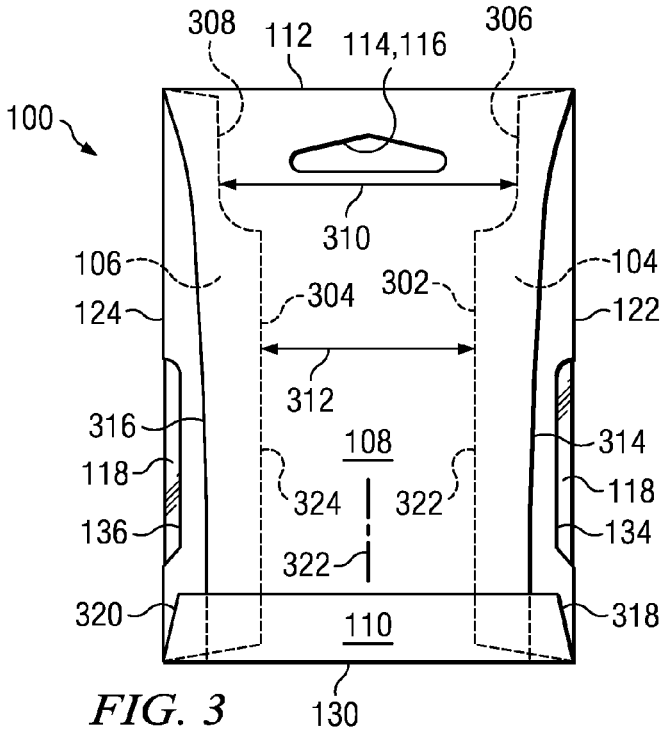
FIG. 3 is a plan view of an assembled envelope showing the side, top, and bottom flaps according to the embodiment of FIG. 1.

Referring again to FIG. 1, at least the front panel 102 preferably comprises a window 118. A transparent sheet 120 may be affixed to an area 132 surrounding the window 118 on an inside surface of at least the front panel 102 such that it seals the window 118 to the surface. The sheet may be affixed by adhesive or by heat sealing the sheet 120 to the inside surface. The first side flap 104 is foldable around a third fold line 122 and, as shown in FIGS. 1, 2, and 3, a portion 134 of the window 118 may extend beyond the third fold line 122 into the first side flap 104. Similarly, the second side flap 106 is foldable around a fourth fold line 124 and a portion 136 of the window 118 may extend beyond the fourth fold line 124 into the second side flap 106.

Referring to FIGS. 1 and 3, the first side flap 104 has an outer margin 302 and is foldable around the third fold line 122. The second side flap 106 has an outer margin 304 that is foldable around the fourth fold line 124. Each margin 302, 304 has a nominal portion 322, 324 and a recessed portion 306, 308 that is closer to the fold line 122, 124 of the respective flap 104, 106. Thus, when the first and second flaps 104, 106 are folded about their respective fold lines 122, 124, a first distance 310 between the recessed outer margins 306, 308 is greater than a second distance 312 between the nominal portions 322, 324.

Additionally, if the window 118 extends into the side flaps 104, 106, as shown in FIGS. 1 and 3, it is preferred that the sides 314, 316 of the top flap 108 and/or the sides 318, 320 of the bottom flap 110 taper inwardly toward a center line 322 of the envelope 100 such that the top flap 108 and/or bottom flap 110 do not occlude the window 118.

The bottom flap 110 is preferably resealable and may use any of a variety of mechanisms such as pressure sensitive adhesives, multiple adhesive strips, or string and button clasps. In a particularly preferred embodiment, a polymeric film such as Mylar® may affixed to either the top flap or the bottom flap. The other of the top and bottom flap has a pressure sensitive adhesive disposed to contact the polymeric film once a silicone release liner is removed from the pressure sensitive adhesive.

The envelope discussed above may be formed by a variety of pieces of equipment known to those of skill in the art. Exemplary machines include cutting and folding machines produced by the F. L. Smithe Machine Company, specifically the RA 800 series.

Figure 4:
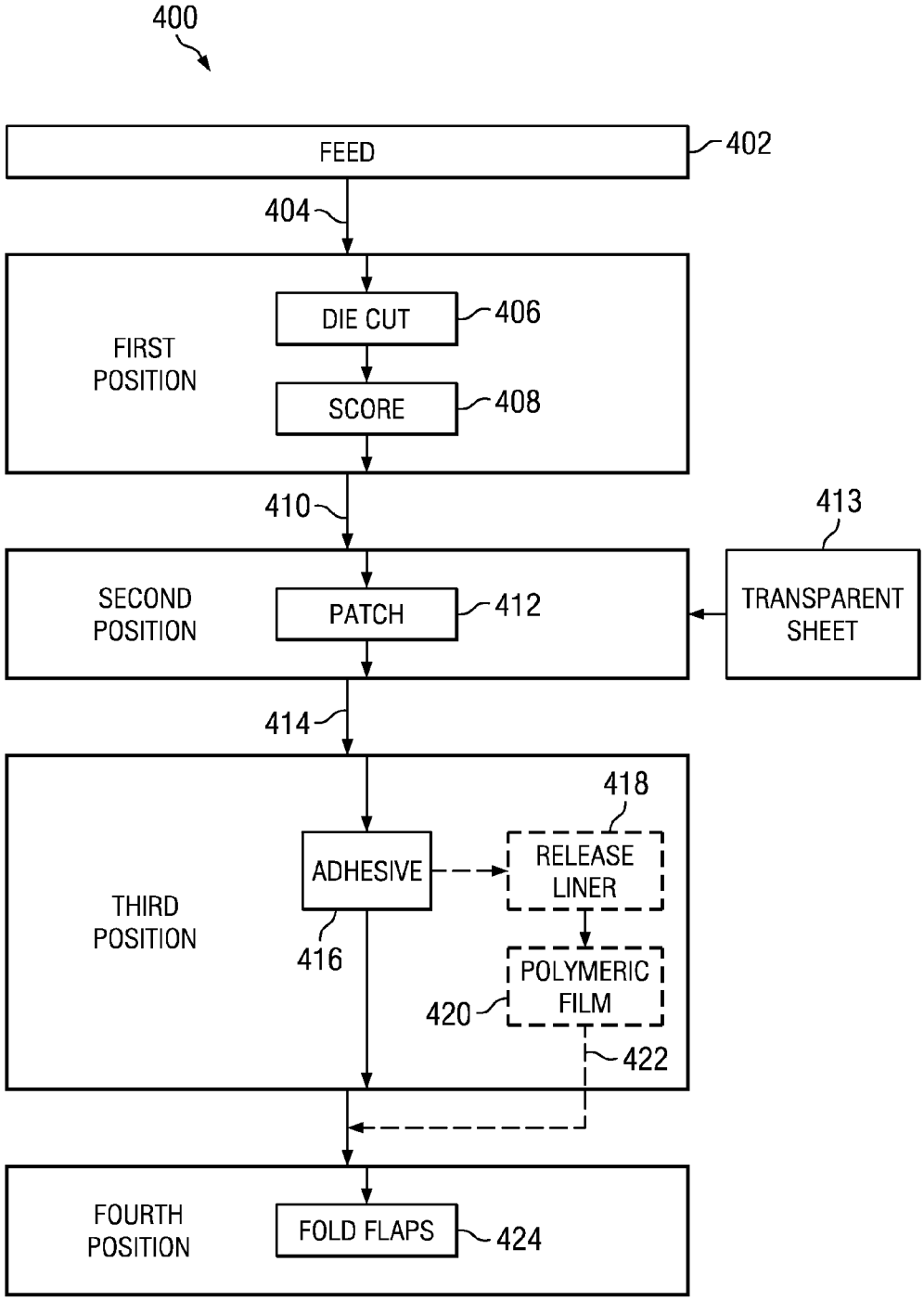
FIG. 4 is a flow diagram showing a method of forming an envelope according to a second embodiment of the invention.

Referring to FIG. 4, a process for forming an envelope, indicated generally at (400), comprises the steps of feeding (402) one or more blanks into an apparatus at a beginning position, transporting (404) the blank to a panel cutter at a first position, and cutting (406) a cut-out from the blank. The cut-out comprises a first display rack hole, a top flap, a bottom flap, and a second display rack hole in either of the top and bottom flaps. The cut-out may also include a window in the front panel. Preferably, the blank is transported to the first position and all subsequent positions by at least one movable vacuum pad. Excess material trimmed from the blank is typically removed through a pneumatic tube which carries the scraps to a hopper to be recycled.

The method further comprises scoring (408) the cut-out along a first fold line such that the first display rack hole registers with the second display rack hole when the flap that has the second display rack hole is folded to be adjacent to the cut-out. The method preferably includes simultaneously scoring the cut-out to create a second fold line for the bottom flap that is opposite the first fold line of the top flap, scoring the cut-out to create a third fold line for a first side flap adjacent to the first fold line, and scoring the cut-out to create a fourth fold line for a second flap adjacent to the first fold line and opposite the third fold line. An area inside the first, second, third, and fourth fold lines forms the front panel. Most preferably, both the steps of cutting (406) and scoring (408) are performed while the cut-out is still at the first position.

The method may further include transporting (410) the cut-out to a patching section at a second position and affixing (412) a transparent sheet (413) to the cut-out such that at least the window is covered by a transparent sheet. Alternatively, the window may extend across the entire width of the front panel and into the side flaps with the transparent sheet covering the window accordingly. The method may further include transporting (414) the cut-out to a seal section at a third position and applying (416) an adhesive to at least one of the top and bottom flaps, most preferably applying adhesive to an area that is proximate to at least one of the first and second display rack holes.

Optionally, the method includes applying (418) a release liner to the adhesive and affixing (420) a polymeric film to the other of the top and bottom flaps. The polymeric film acts as a smooth, durable surface to which the adhesive may be repeatedly attached and removed. The release liner acts as a protective cover over the adhesive, preventing premature adhesion and the collection of debris. The release liner is typically made of a silicone-containing material. In the event that no polymeric film is used, the adhesive may be dried in a drying tunnel before the cut-out moves for further processing.

Once the adhesive is applied, the method preferably includes transporting (422) the cut-out to a folding section at a fourth position and folding (424) the top flap around the first fold line and at least two of the remaining flaps around their respective fold lines. Thus, the front panel and the three folded flaps form a compartment with one open side, through which the contents may be inserted. The area to which the adhesive was applied seals the area proximate to the display rack holes from the compartment.

In summary, the sealed display rack holes allow envelopes containing small articles such as seeds or beads to be hung on a display rack, enhancing the visibility of the envelope and the product. This is advantageous for buyers because they can verify the quality and quantity of the goods and advantageous for sellers because the increased visibility is more likely to translate to higher sales. The described methods of forming the envelopes are also advantageous for sellers because the envelopes can be made from a single blank on equipment that is widely available, reducing the sellers' overall costs.

While illustrated embodiments of the present invention have been described and illustrated in the appended drawings, the present invention is not limited thereto but only by the scope and spirit of the appended claims.

We claim:

1. An envelope formed from a blank, comprising:

a front panel of the blank having a first display rack hole, a first margin, a second margin opposite the first margin, a third margin joining the first and second margins, and a fourth margin opposite the third margin which joins the first and second margins;

a first side flap of the blank joined to the first margin of the front panel;

a second side flap of the blank joined to the second margin of the front panel;

a top flap of the blank joined to the third margin of the front panel and having a free end;

a bottom flap of the blank joined to the fourth margin of the front panel and having a free end;

a second display rack hole in the top flap and disposed to be in registry with the first display rack hole when the top flap is folded behind the front panel;

sides of the top flap tapering toward a center line of the envelope from a respective one of the third and fourth margins to the free end of said top flap;

a window formed across the front panel and extending into the first flap and the second flap, a transparent sheet affixed across the window, such that when the first flap and the second flap are folded behind the front panel, see-through windows will result by which an observer can see all of the way through the envelope within the see-through windows;

the top flap folded behind the front panel, the tapering of the top flap being such that it does not occlude the see-through windows.

2. The envelope of claim 1, wherein the bottom flap is resealable.

3. The envelope of claim 2, further comprising a polymeric film affixed to one of the top flap and the bottom flap, the other of the top flap and bottom flap comprising a release liner and an adhesive disposed to contact the polymeric film once the release liner is removed from the adhesive.

4. The envelope of claim 3, wherein the adhesive is a pressure sensitive adhesive.

5. The envelope of claim 1, wherein the blank is made of a material selected from the group consisting of paper, polymer, and combinations thereof.

6. The envelope of claim 1, wherein the area proximate the first and second display rack holes is sealed with adhesive.

7. The envelope of claim 1, wherein the area proximate the first and second display rack holes is heat sealed.

8. An envelope formed from a blank, comprising:

a front panel of the blank having a first display rack hole, a first margin, a second margin opposite the first margin, a third margin joining to first and second margins, and a fourth margin opposite the third margin which joins the first and second margins;

a first side flap of the blank joined to the first margin of the front panel;

a second side flap of the blank joined to the second margin of the front panel;

a top flap of the blank joined to the third margin of the front panel and having a free end;

a bottom flap of the blank joined to the fourth margin of the front panel and having a free end;

a second display rack hole in the top flap and disposed to be in registry with the first display rack hole when the top flap is folded behind the front panel;

the front panel having a first width from the first margin to the second margin;

a window formed across the front panel and extending into the first flap by a second width and into the second flap by a third width, a transparent sheet affixed across the window, such that when the first and second side flaps are folded behind the front panel, see-through windows will result by which an observer can see all of the way through the envelope within the see-through windows, the window positioned across the front panel to vertically extend through a vertical window zone on the front panel;

the top flap folded behind the front panel such that a portion thereof intersects with the vertical window zone, a fourth width of said top flap, measured within the vertical window zone, being less than the first width as decreased by the second width and third width, such that said top flap does not occlude the see-through windows.

9. The envelope of claim 8, wherein both bottom and top flaps have widths, measured within the vertical window zone, which are less than the first width minus the sum of the second width and the third width.

* * * * *